US005080311A

United States Patent [19]

Engstrom

[11] Patent Number: 5,080,311

[45] Date of Patent: Jan. 14, 1992

[54] SELF-ADJUSTING/LOCKING SHELF BRACKET

[76] Inventor: Hartley A. Engstrom, 1217 Caballero, Redlands, Calif. 92373

[21] Appl. No.: 519,100

[22] Filed: May 2, 1990

Related U.S. Application Data

[63] Continuation-in-part of Ser. No. 375,710, Jul. 5, 1989, abandoned.

[51] Int. Cl.[5] ..... A47G 29/02

[52] U.S. Cl. ..... 248/250; 108/108

[58] Field of Search ..... 248/551, 201, 235, 239, 248/243, 247, 250, 309.1, 316.1; 108/106, 107, 108, 110, 96, 98; 211/190, 192, 193, 187, 135, 153

[56] References Cited

U.S. PATENT DOCUMENTS

| | | | |
|---|---|---|---|
| 3,471,111 | 10/1969 | MacDonald | 248/235 |
| 3,471,112 | 10/1969 | MacDonald | 248/239 |
| 3,759,191 | 9/1973 | Freeman | 248/239 |
| 4,037,813 | 7/1977 | Loui | 108/110 |
| 4,053,132 | 10/1977 | Del Pozzo | 248/235 |
| 4,432,523 | 2/1984 | Follows | 248/250 |
| 4,666,117 | 5/1987 | Taft | 108/108 |
| 4,732,358 | 3/1988 | Hughes | 108/108 |
| 4,765,575 | 8/1988 | Bergl | 248/250 |
| 4,819,901 | 4/1989 | McDonald | 248/250 |
| 4,830,323 | 5/1989 | Harley | 108/108 |
| 4,856,746 | 8/1989 | Wrobel | 108/107 |
| 4,909,465 | 3/1990 | Lyman | 248/250 |

FOREIGN PATENT DOCUMENTS

| | | | |
|---|---|---|---|
| 1540224 | 2/1979 | United Kingdom | 248/250 |

*Primary Examiner*—Alvin C. Chin-Shue
*Assistant Examiner*—Robert A. Olson
*Attorney, Agent, or Firm*—Donald A. Streck

[57] ABSTRACT

A unitary shelf bracket for mounting to vertically spaced holes in a vertical side member to support the ends of a shelf wherein the bracket is self-adjusting and shelf-locking. The bracket is formed of a tough resiliently flexible plastic and has a backplate portion having front and back surfaces and a shelf support member extending horizontally outward normal to the front surface adjacent a bottom end thereof. There is a first peg lying on a centerline of the backplate portion, sized to fit into the holes, and extending outward normal to the back surface adjacent a top end thereof. There is also a second peg similar to the first to fit into another adjacent hole. A plurality of first fingers extend downward from adjacent the top end of the backplate at an acute angle thereto and terminate in respective bottom edges parallel to the shelf support member at different spaced distances therefrom. A pair of upward tilted second fingers are disposed at respective side edges of the shelf support member. The first and second fingers are of a thickness to make them stiffly resiliently flexible. A front one of the second fingers acts as a horizontal stop for a shelf on the bracket.

17 Claims, 4 Drawing Sheets

SELF-ADJUSTING/LOCKING SHELF BRACKET

BACKGROUND OF THE INVENTION

This application is a continuation-in-part of application Ser. No. 375,710, filed July 5, 1989, now abandoned.

This invention relates to brackets used for supporting shelves between opposed vertical side members and, more particularly, to a unitary shelf bracket of a tough resiliently flexible plastic for mounting to vertically spaced holes in a vertical side member to support the end of a shelf comprising, a backplate portion having front and back surfaces; a first peg lying on a centerline of the backplate portion, sized to fit into the holes, and extending outward normal to the back surface adjacent a top end thereof; a second peg sized to fit into the holes extending outward normal to the back surface at a distance downward from the first peg such as to allow the first and second pegs to simultaneously fit into adjacent ones of the holes; a shelf support member extending horizontally outward normal to the front surface adjacent a bottom end thereof; means for imparting a longitudinal centering force on a shelf disposed in the backplate portion; and, means for imparting a vertical gripping force on a shelf disposed in the shelf support member.

Modular furniture is quite popular and all indications are that it will remain so for many years to come. Bookshelf units, entertainment centers, breakfronts, etc. all include shelves. Typically, the shelves are made to be vertically adjustable so as to readily adapt to individual needs. As shown in FIG. 1, the simplest prior art approach to adjustably supporting a shelf 10 between opposed vertical side members 12 is to drill a plurality of opposed, spaced holes 14 in the side members 12 into which pegs 16 (such as short lengths of dowel rod) can be removably inserted at the desired height. The ends of the shelf 10 then rest on and are supported by the pegs 16.

The majority of the modular furniture being built is constructed of so-called "particle board" with a plastic or wood veneer applied to the surfaces thereof for decorative purposes. The particle board is made by pressing and rolling a mixture of wood chips and a bonding agent such as a resin. The type and size of the chips, the ratio of chips to bonding agent, and type of bonding agent varies greatly. It is not uncommon to find the edges of the holes 14 crumbling away and the inner surfaces of the holes 14 being of varying size and texture. As a result, it is often difficult to get wooden pegs to fit into the holes and/or to get them out once driven in. Moreover, as the edges of the holes 14 crumble, it may be impossible to keep a peg in the hole.

In view of these conditions and the obvious popularity of the modular furniture, various bracket replacements for the wooden pegs 16 of FIG. 1 were introduced in the prior art as depicted in FIGS. 2–8. The first, as shown in FIG. 2, were L-shaped metal brackets 18 having a cylindrical metal peg 16' extending therefrom. Later, in the interest of economy, the metal brackets 18 were replaced by similarly shaped plastic brackets 18' as shown in FIG. 3. Because of the less rigid nature of the plastic brackets 18', they were rotated 180° and a support 20 was formed therein to brace the horizontal portion supporting the shelf 10 against the vertical portion carrying the peg 16'' extending into the hole 14.

The foregoing shelf supports had an advantage in common. They could support shelves of varying thicknesses since all support came from the bottom. They also shared a common disadvantage—the shelves were loose between the side members 12; that is, any vertical force on the shelf 10 could cause it to come loose and fall. Thus, in an earthquake, or such, the shelves could come loose, fall, and drop their contents. Also, this meant that the shelves could not be shipped in place between the side members 12. This, of course, adds to the packing and shipping costs attendant to the article as the shelves and brackets therefor have to be wrapped separately. In an effort to solve these shortcomings of the above-described prior art shelf supports, several modifications thereof have been introduced.

In U.S. Pat. No. 3,471,111, as depicted in FIG. 4, MacDonald shows a spring steel finger member 22 which is mounted between the bracket 18' and the side member 12. To provide for different shelf thicknesses, the finger member 22 has a plurality of holes therein at different locations through which the peg 16'' of the bracket 18' can be inserted. The finger member 22 does not impart a lateral centering force on the shelf 10. Likewise, it does not impart a vertical gripping force on the shelf 10.

In U.S. Pat. No. 3,471,112, as depicted in FIG. 5, MacDonald et al. show the finger member 22' as being formed as part of the bracket 18'. In this version, there is no provision for different shelf thicknesses. In one embodiment, there are triangular webs facing upward so as to dig into the end edges of the shelf and simultaneously urge it towards the center. There is no vertical gripping force on the shelf 10. The recent patent of Wrobel et al. (U.S. Pat. No. 4,856,746) shows a variation of this approach which permits the bracket to support shelves of two different thicknesses. A first flexible tab extends downward to engage the top of a shelf of maximum thickness with its outward extending lip and a second flexible tab extends upward to engage the top of a shelf of minimum thickness with its outward extending lip. The horizontal bottom support of the bracket also includes a slot into which a pin on a shelf can be inserted to prevent the shelf from sliding forward.

FIG. 6 depicts a variation according to U.S. Pat. No. 4,053,132 of DelPozzo wherein the finger member is replaced by a curved button 24 of a resiliently deformable material. The shelf 10 is squeezed past the button 24 which then expands and, theoretically, holds the shelf 10 in place. With this apparatus, both the thickness and length of the shelf are critical. There is no vertical gripping force on the shelf 10.

FIG. 7 depicts a variation according to U.S. Pat. No. 4,037,813 of Loui et al. wherein the finger member is replaced by an integral arched member 26. The shelf 10 is squeezed past the lip 28 which causes the arched back 30 to flex outward. The arched back 30 then flexes back inward imparting a slight centering force with the lip 28 preventing any upward movement of the shelf 10. There is no vertical gripping force on the shelf 10. There is no adaptability for different shelf thicknesses.

FIG. 8 depicts still another variation according to U.S. Pat. No. 4,732,358 of Hughes et al. wherein the downward-facing finger member 22 of FIG. 5 is augmented by an upward-facing arched finger 32 which is intended to impart a centering force on the shelf 10.

There is no vertical gripping force on the shelf 10. Likewise, there is no adaptability for different shelf thicknesses.

Despite the various plastic shelf supports that have been made available in the prior art, it is important to note that not one such plastic shelf support has been certified as Product Grade 1 performance level as outlined in the specification in the ANSI/BHMA A156.9-1988 booklet defining the American National Standard for cabinet hardware as set by the American National Standards Institute, Inc. and the Builders Hardware Manufacturers Association, Inc. (a copy of which was filed in the parent case).

Note also that in all of these prior art shelf supports the construction is such as to impart a rotating, edge-crumbling force on the edges of the holes 14 which ultimately results in shelf support failure.

Note additionally that in all of these prior art shelf supports there is no provision for preventing a shelf from moving horizontally outward from between the shelf supports.

Wherefore, it is an object of the present invention to provide a shelf bracket for use in modular furniture and the like which holds the shelves securely enough to allow them to be shipped in place so that special wrapping for shipment is not necessary.

It is another object of the present invention to provide a shelf bracket for use in modular furniture and the like which holds the shelves securely enough to prevent shelf loss during shaking such as encountered in a earthquake.

It is still another object of the present invention to provide a shelf bracket for use in modular furniture and the like which is of unitary plastic construction and therefore simple and inexpensive to manufacture such as by injection molding procedures.

It is yet another object of the present invention to provide a shelf bracket for use in modular furniture and the like which automatically self-adjusts to varying thicknesses of shelves within a wide range of common sizes.

It is yet a further object of the present invention to provide a shelf bracket for use in modular furniture and the like which is of a construction which does not impart a rotating, edge-crumbling force on the edges of the holes into which it is inserted but rather spreads the shelf-supporting load into two vertically adjacent holes as a shear force only.

It is a further object of the present invention to provide a shelf bracket for use in modular furniture and the like which is of plastic construction and still is capable of being certified as Product Grade 1 performance level.

It is a still further object of the present invention to provide a shelf bracket for use in modular furniture and the like which includes a stop for preventing a shelf resting thereon from moving horizontally outward.

Other objects and benefits of this invention will become apparent from the detailed description which follows when reviewed in conjunction with the drawing figures with accompany it.

SUMMARY

The foregoing objects have been achieved in the unitary shelf bracket of a tough resiliently flexible plastic for mounting to vertically spaced holes in a vertical side member to support the end of a shelf of the present invention comprising, a backplate portion having front and back surfaces; a first peg lying on a centerline of the backplate portion, sized to fit into the holes, and extending outward normal to the back surface adjacent a top end thereof; a shelf support member extending horizontally outward normal to the front surface adjacent a bottom end thereof; a plurality of first fingers extending downward from adjacent the top end of the backplate at an acute angle thereto and terminating in respective bottom edges parallel to the shelf support member at different spaced distances therefrom, the first fingers being of a thickness to make them stiffly resiliently flexible; and, a pair of upward tilted second fingers disposed at respective side edges of the shelf support member, the second fingers being of a thickness to make them stiffly resiliently flexible whereby the second fingers impart an upward force against any downward flexing force thereon.

In the preferred embodiment, there is also a second peg sized to fit into the holes extending outward normal to the back surface at a distance downward from the first peg such as to allow the first and second pegs to simultaneously be fit into adjacent ones of the holes. Also, the first fingers comprise a tab-shaped finger disposed on the centerline and a plurality of U-shaped fingers wrapped around the tab-shaped finger. Additionally, the second fingers each have an attached end adjacent a front edge of the shelf support member and a free end adjacent the backplate.

DESCRIPTION OF THE PREFERRED EMBODIMENT

Figure 1:
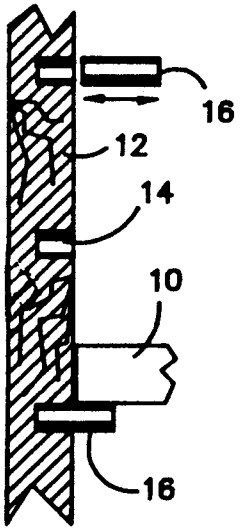
PRIOR ART FIG. 1
FIG. 1 is a simplified drawing showing a first prior art approach to supporting a shelf between opposed vertical side members.
Figure 2:
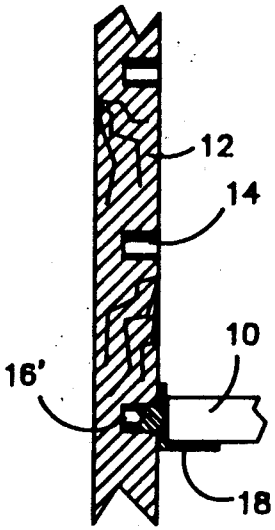
PRIOR ART FIG. 2
FIG. 2 is a simplified drawing showing a second prior art approach to supporting a shelf between opposed vertical side members.
Figure 3:
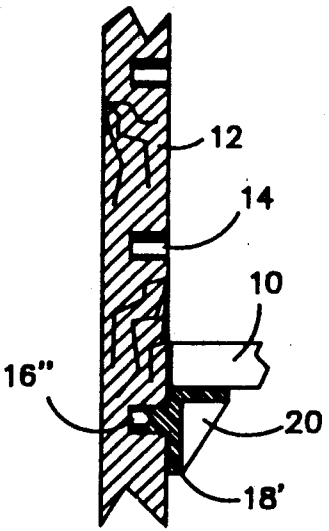
PRIOR ART FIG. 3
FIG. 3 is a simplified drawing showing a third prior art approach to supporting a shelf between opposed vertical side members.
Figure 4:
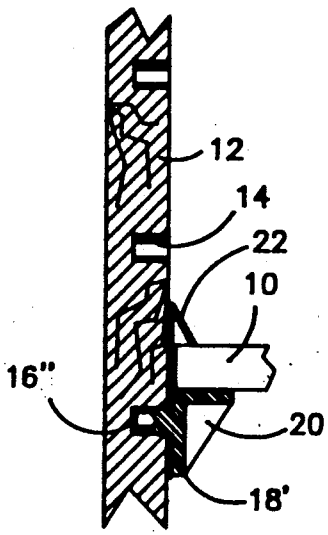
PRIOR ART FIG. 4
FIG. 4 is a simplified drawing showing a fourth prior art approach to supporting a shelf between opposed vertical side members.
Figure 5:
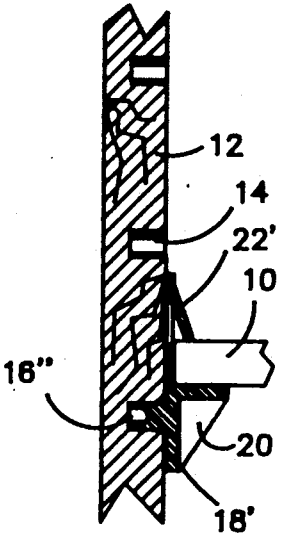
PRIOR ART FIG. 5
FIG. 5 is a simplified drawing showing a fifth prior art approach to supporting a shelf between opposed vertical side members.
Figure 6:
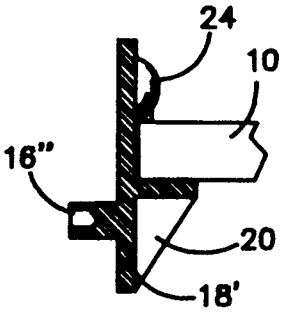
PRIOR ART FIG. 6
FIG. 6 is a simplified drawing showing a sixth prior art approach to supporting a shelf between opposed vertical side members.
Figure 7:
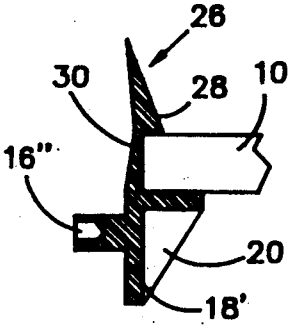
PRIOR ART FIG. 7
FIG. 7 is a simplified drawing showing a seventh prior art approach to supporting a shelf between opposed vertical side members.
Figure 8:
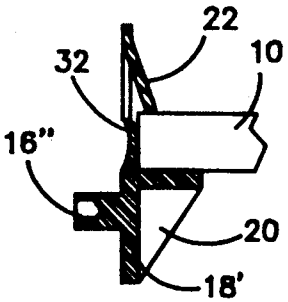
PRIOR ART FIG. 8
FIG. 8 is a simplified drawing showing a eighth prior art approach to supporting a shelf between opposed vertical side members.
Figure 11:
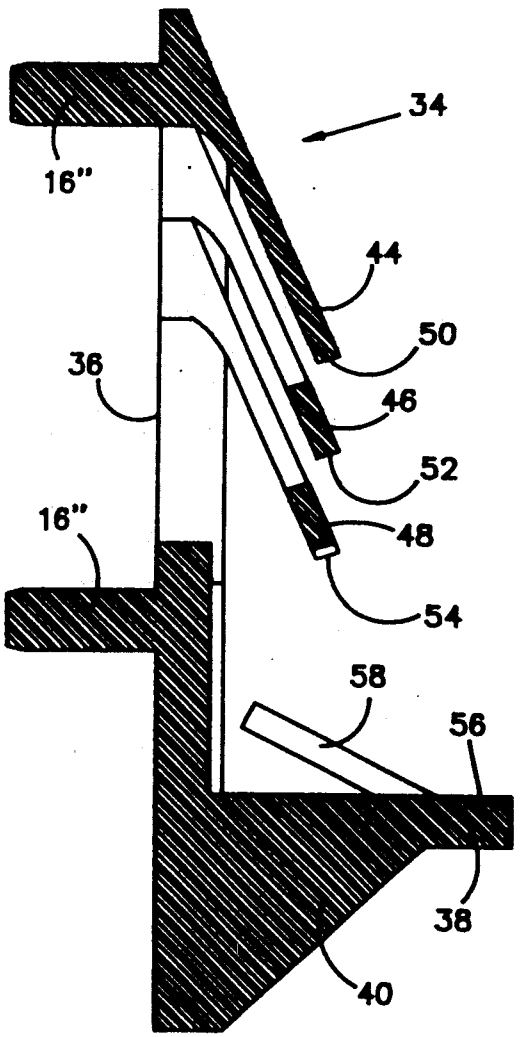
FIG. 11 is a cutaway drawing of the bracket of FIGS. 9 and 10 along the center line thereof.
Figure 10:
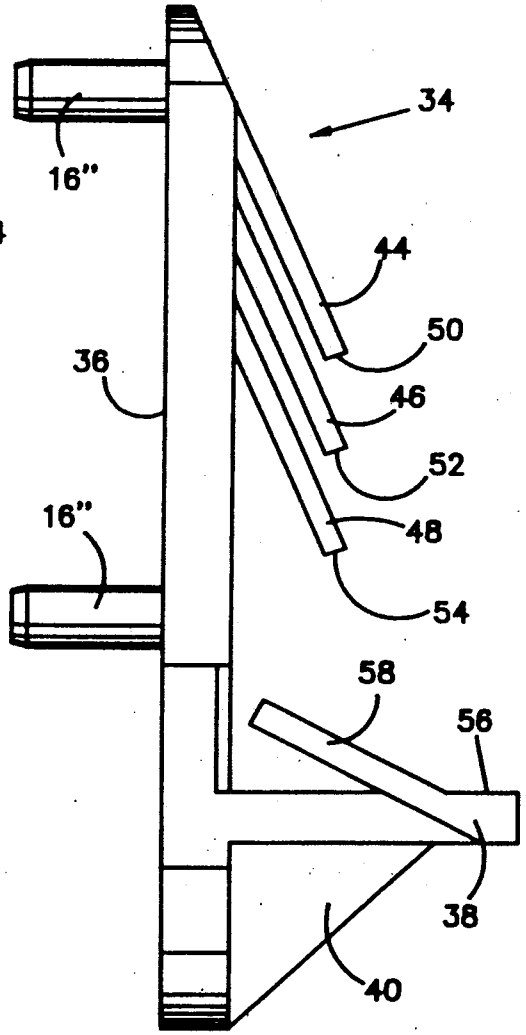
FIG. 10 is a detailed side elevation drawing of the bracket of FIG. 9.
Figure 9:
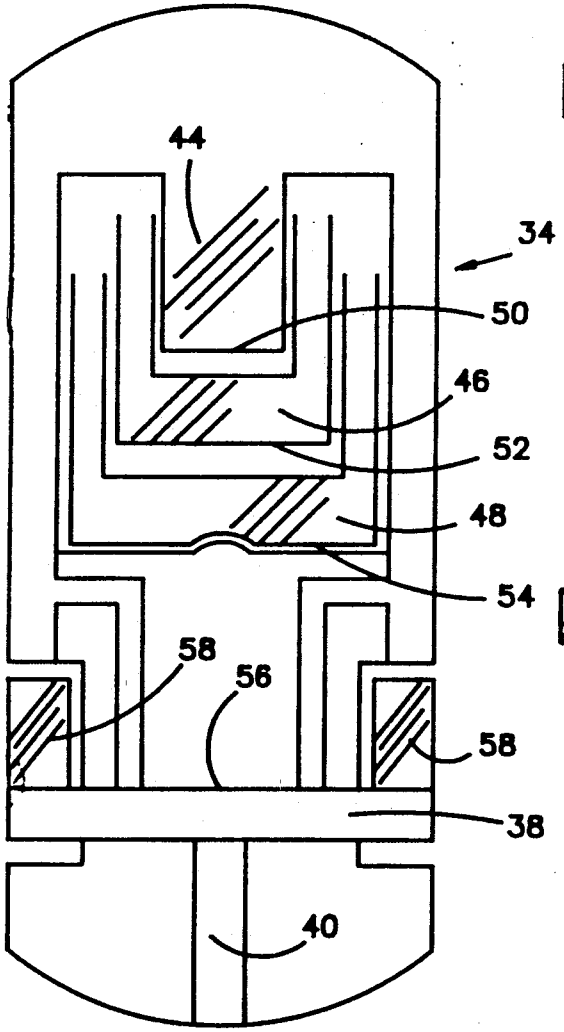
FIG. 9 is a detailed front elevation drawing of a bracket according to the present invention for supporting a shelf between opposed vertical side members.
Figure 13:
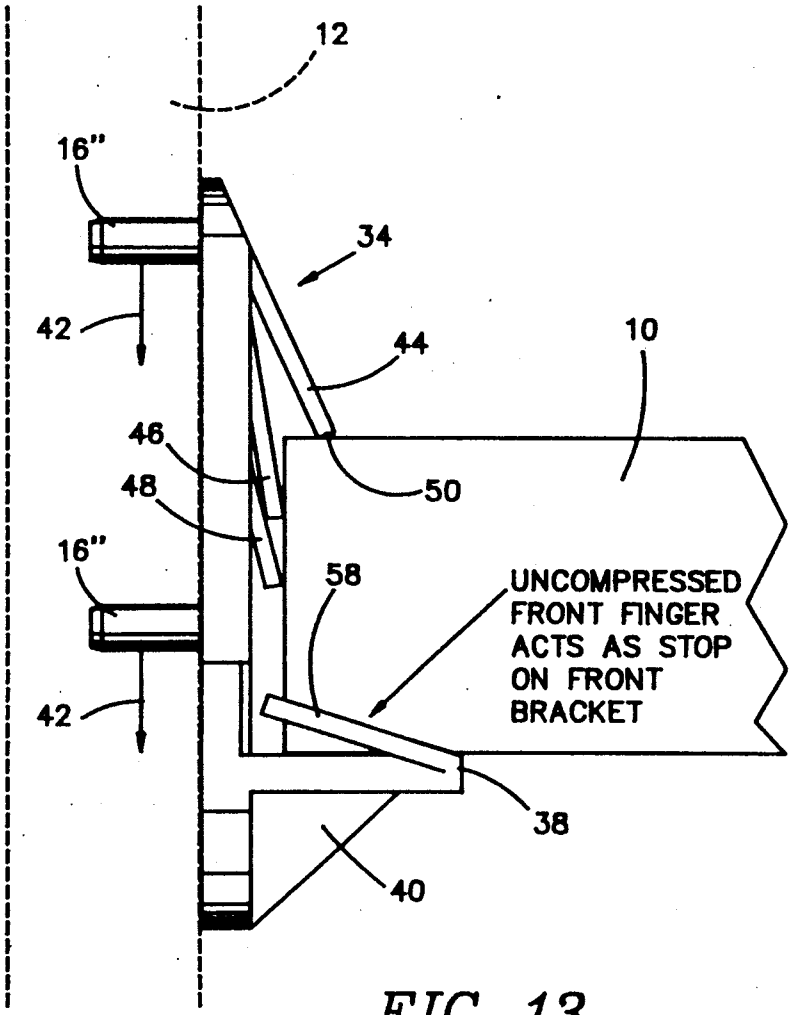
FIG. 13 is a drawing of the bracket of the present invention as in FIG. 10 showing how it provides automatic self-adjusting and locking of a large thickness shelf and also how the front bracket provides a stop for preventing a shelf from moving horizontally outward.
Figure 12:
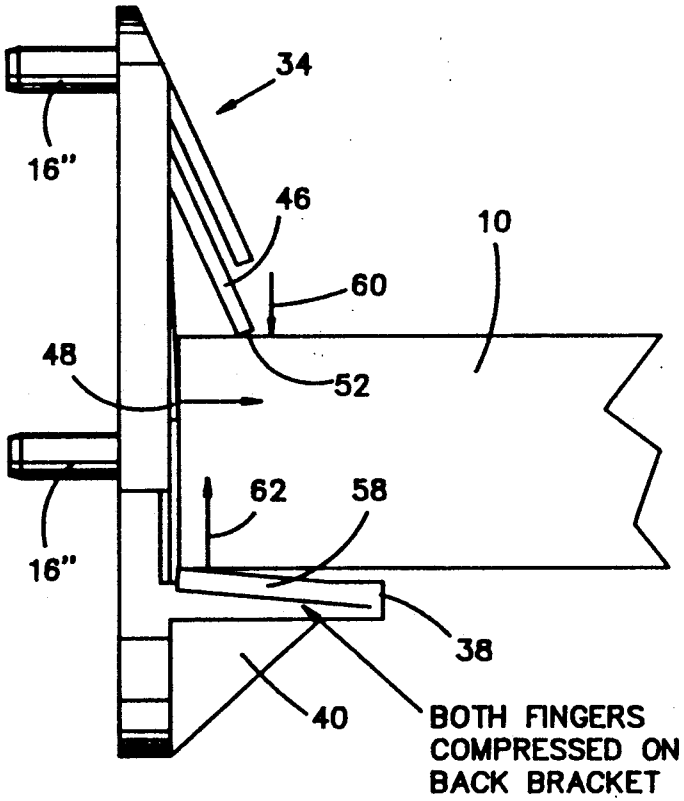
FIG. 12 is a drawing of the bracket of the present invention as in FIG. 10 showing how it provides automatic self-adjusting and locking of a medium thickness shelf.

The shelf bracket of this invention is shown in FIGS. 9-11, wherein it is generally designated as 34, and its manner of operation is depicted in FIGS. 12 and 13. It is of unitary construction and in commercially tested embodiments thereof as depicted in the drawing figures (and as certified as Product Grade 1) it was made by injection molding employing a tough resiliently flexible plastic. The preferred plastic is impact modified polyamide nylon 6—6 thermoplastic available from DuPont under the brandname Zytel 408. By way of example of the adaptability of the bracket of the present invention to be described hereinafter, four such brackets supporting a shelf were able to support three individuals standing thereon and weighing a total of over five hundred pounds without any damage to the brackets. The flexing members incorporated therein returned to their original positions following removal of the weight. As evidenced by the certification letter filed with this application, the tested embodiments of the present invention were also the first, and only, plastic brackets ever to be accorded a Product Grade 1 certification.

The bracket 34 of this invention comprises an elongated vertical backplate 36 having a support member 38 extending horizontally outward therefrom adjacent the bottom thereof. A triangular support strut 40 is formed between the support member 38 and the backplate 36 along the centerline of both. A pair of support pegs 16'' extend outward from the back surface of the backplate 36. One is adjacent the top of the backplate 36 and the second is located at a common hole spacing distance from the first. As can be appreciated (and as depicted by the dashed lines in FIG. 13) the bracket 34 hangs from the two pegs 16'' imparting only a shear force on the side member 12 as depicted by the arrows 42 in FIG. 13. Thus, in that aspect alone, the bracket 34 of this invention is an improvement over the prior art by eliminating the hole deforming forces common to prior art shelf supports.

The automatic self-adjusting and shelf locking features of the bracket 34 are contained in the flexing members now to be described. Shelf thickness adjustability and centering forces are provided by the plurality of nested, downward-facing fingers 44, 46, and 48. Finger 44 is a rectangular tab lying along the centerline of the backplate 36 while fingers 46 and 48 are rectangular U-shaped fingers wrapping around the finger 44. Accordingly, the fingers 44, 46, 48 terminate in bottom edges 50, 52, 54, respectively, which are at spaced distances from the top surface 56 of the support member 38. The distances from the bottom edges 50, 52, 54 to the top surface 56 of the support member 38 are chosen to nominally correspond to the most common shelf thicknesses, i.e. ½ inch, ¾ inch and 1 inch. The thickness of the fingers 44, 46, 48 is such as to make them stiffly, resiliently flexible so that they will flex but impart a relatively high centering force on the shelf.

Vertical gripping and shelf thickness adjustability as well as horizontal movement prevention are provided by the upward-tilted flexing fingers 58 disposed along the side edges of the support member 38 in combination with the fingers 44, 46, 48 described above. The two flexing fingers 58 are preferably formed as tilting upward from the front edge of the support member 38 for purposes of ease of injection molding; but, could also be formed as tilting upward from the back edge of the support member 38 adjacent the backplate 36, if desired. As with the fingers 44, 46, 48, the thickness of the fingers 58 is such as to make them stiffly, resiliently flexible so that they will flex but impart a relatively high lifting force on the shelf.

The operation of the bracket 34 can best be understood with reference to FIGS. 12 and 13. With a medium thickness shelf 10 as shown in FIG. 12, the shelf is gripped vertically, as indicated by the arrows 60, 62, by abutting against the bottom edge 52 of finger 46 on the top and by the high lifting force of the flexed fingers 58 on the bottom. A centering force is imparted by the flexed finger 48 bearing against the end of the shelf 10. With a thicker shelf 10 as depicted in FIG. 13, the shelf is gripped vertically by abutting against the bottom edge 50 of finger 44 on the top and by the high lifting force of the flexed fingers 58 on the bottom. A centering force is imparted by the flexed fingers 46 and 48 bearing against the end of the shelf 10.

As can be appreciated, the bracket 34 automatically adjusts to varying shelf thicknesses and firmly grips the shelf 10 against movement in all directions to a degree sufficient to prevent movement during shipment with the shelf in place or during violent shaking such as during an earthquake.

Note also that there are typically two brackets 34 on each end of the shelf 10. The bracket 34 supporting the back edge of the shelf 10 is depicted in FIG. 12. In that case, both of the fingers 58 are under the shelf 10 and impart only an upwards force. By contrast, the bracket 34 supporting the front edge of the shelf 10 in its preferred orientation is depicted in FIG. 13. In this case, the back finger 58 is under the shelf 10 and flexed just like the fingers 58 of the back bracket 34. The front finger 58, however, is disposed in front of the front edge of the shelf 10 and is unflexed. It, therefore, acts as a stop to prevent the shelf 10 from moving horizontally outward from between the brackets 34. This feature of the bracket 34 of this invention is unique in and of itself and is of extreme importance with respect to the performance of this bracket as it prevents loss of the shelf 10 when shipped in place and in the event of an earthquake.

Figure 16:
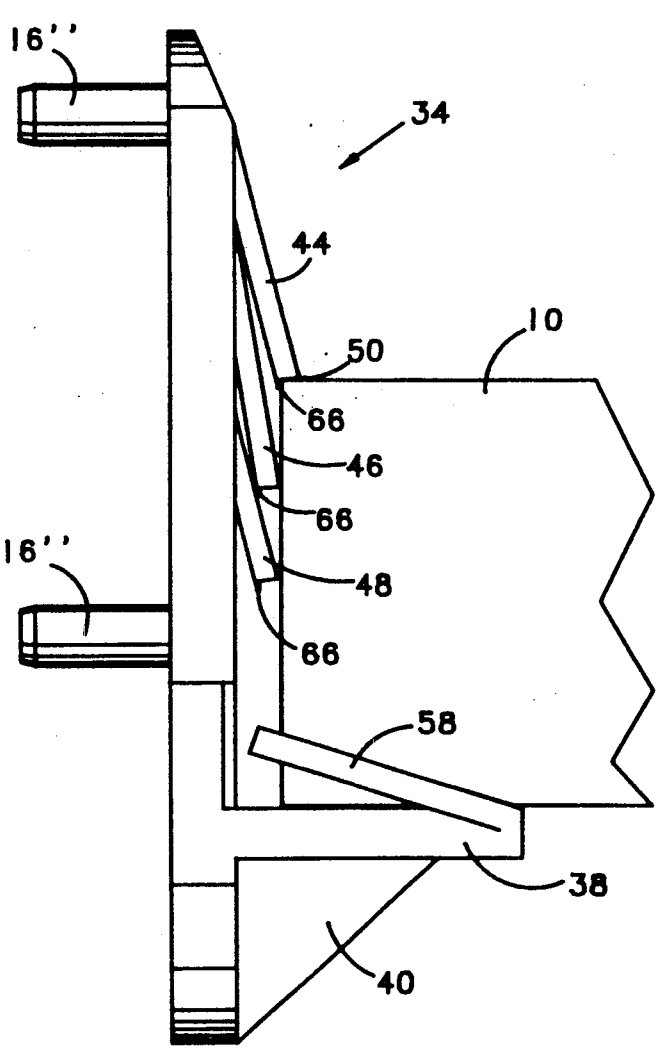
FIG. 16 is a drawing of the bracket of the present invention as in FIG. 13 showing how the retaining tabs of FIG. 15 prevent the fingers from being bent as in FIG. 14.
Figure 15:
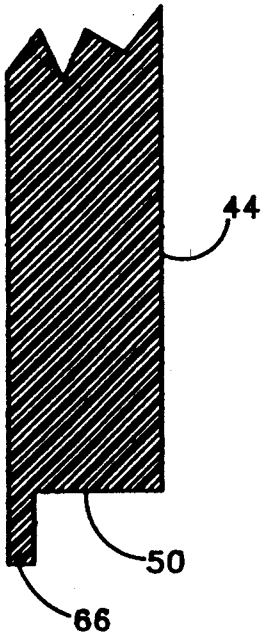
FIG. 15 is an enlarged cutaway drawing through the end of a finger of the present invention showing the preferred retaining tab formed therein to prevent the situation depicted in FIG. 14.
Figure 14:
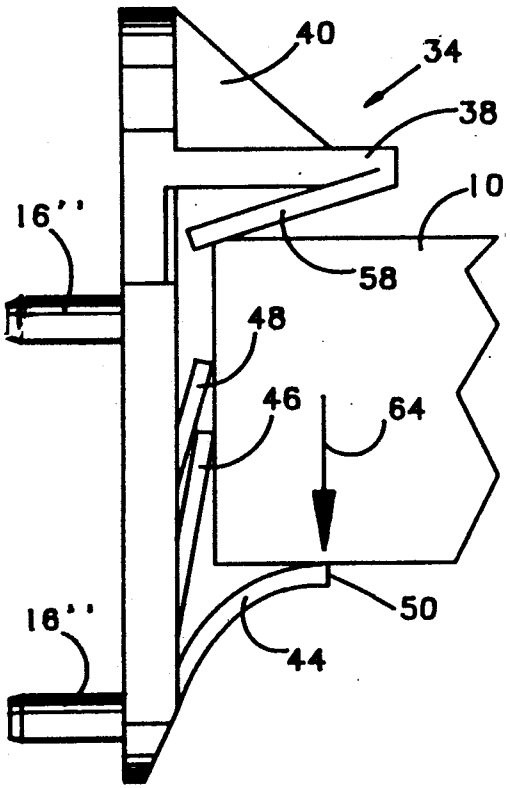
FIG. 14 is a drawing of the bracket of the present invention inverted with a shelf in place as could take place during shipment and depicting how the fingers could be bent over from the weight of the shelf.

In testing the bracket of the present invention under shipping conditions with a shelf in place, it was found that the condition depicted in FIG. 14 could take place; that is, the retaining finger (such as finger 44 in FIG. 14) could be bent over from the weight of the shelf 10 as represented by the arrow 64. This could only take place, however, if the bottom edge 50 was able to slip along the surface of the shelf 10. As long as the bottom edge 50 remained in contact with the shelf 10 in an abutting relationship thereto, a compressive force is imparted on the finger 44 by the weight of the shelf;

and, the finger 44 is able to resist that compressive force without distortion. To prevent this undesirable phenomenon from ever occurring, a retaining tab 66 is formed into the back edge of each bottom edge 50, 52, 54 of the fingers 44, 46, 48 as shown in FIG. 15 by way of example. The retaining tabs 66 are not very thick or very long as they have to resist very little force. Also, it is desirable to have a maximum amount of the bottom edges 50, 52, 54 available to press against the surface of the shelf 10. As depicted in FIG. 16, the retaining tabs 66 catch the side edge of the shelf 10 and keep the finger (such as finger 44) in a position where it is as vertical as possible and, therefore, subjected to the maximum compressive force possible and the minimum force tending to move it over center and bend it as in FIG. 14.

Wherefore, having thus described the present invention, what is claimed is:

1. A unitary shelf bracket of a tough resiliently flexible plastic for mounting to vertically spaced holes in a vertical side member to support the end of a shelf comprising:

a) a backplate portion having front and back surfaces;

b) a first peg lying on a centerline of said backplate portion, sized to fit into the holes, and extending outward normal to said back surface adjacent a top end thereof;

c) a shelf support member extending horizontally outward normal to said front surface adjacent a bottom end thereof;

d) a plurality of first fingers extending downward from adjacent said top end of said backplate at an acute angle thereto and terminating in respective bottom edges parallel to said shelf support member at different spaced distances therefrom, said first fingers being of a thickness to make them stiffly resiliently flexible; and, e) a pair of upward tilted second fingers disposed at respective side edges of said shelf support member, said second fingers being of a thickness to make them stiffly resiliently flexible whereby said second fingers impart an upward force against any downward flexing force thereon.

2. The unitary shelf bracket of claim 1 and additionally comprising:

a second peg sized to fit into the holes extending outward normal to said back surface at a distance downward from said first peg such as to allow said first and second pegs to simultaneously be fit into adjacent ones of the holes.

3. The unitary shelf bracket of claim 1 wherein:

said first fingers comprise a tab-shaped finger disposed on said centerline and a plurality of U-shaped fingers wrapped around said tab-shaped finger.

4. The unitary shelf bracket of claim 3 wherein:

said first fingers each have a retaining tab at a bottom end thereof for gripping an edge of a shelf to maintain said bottom end in an abutting relationship with said shelf.

5. The unitary shelf bracket of claim 1 wherein:

said second fingers each have an attached end adjacent a front edge of said shelf support member and a free end adjacent said backplate.

6. A unitary shelf bracket of a tough resiliently flexible plastic for mounting to vertically spaced holes in a vertical side member to support the end of a shelf with opposing top and bottom surfaces, said unitary shelf bracket comprising:

a) a backplate portion having front and back surfaces;

b) a first peg lying on a centerline of said backplate portion, sized to fit into the holes, and extending outward normal to said back surface adjacent a top end thereof;

c) a second peg sized to fit into the holes extending outward normal to said back surface at a distance downward from said first peg such as to allow said first and second pegs to simultaneously fit into adjacent ones of the holes;

d) a shelf support member extending horizontally outward normal to said front surface adjacent a bottom end thereof;

e) means in said backplate portion for imparting a longitudinal centering force on said shelf disposed on said shelf support member;

f) means for imparting a vertical compressive gripping force to said top and bottom surfaces of said shelf disposed on said shelf support member;

g) means for gripping a front edge of said shelf disposed on said shelf support member to prevent horizontal outward movement thereof; and, wherein said means for imparting a longtiudinal centering force on a shelf and said means for imparting a vertical gripping force on a shelf comprises:

a plurality of first fingers extending downward from adjacent said top end of said backplate an at acute angle thereto and terminating in respective bottom edges parallel to said shelf support member at different spaced distances therefrom, said first fingers being of a thickness to make them stiffly resiliently flexible and comprising a tab-shaped finger disposed o a centerline and a plurality of U-shaped fingers wrapped around said tab-shaped finger.

7. The unitary shelf bracket of claim 6 wherein:

said first fingers each have a retaining tab at said bottom edge thereof for gripping an edge of a shelf to maintain said bottom edge in an abutting relationship with said shelf.

8. The unitary shelf bracket of claim 6 wherein:

said means for imparting a vertical gripping force and said means for gripping a front edge comprise a pair of upward tilted second fingers disposed at respective side edges of said shelf support member, said second fingers being of a thickness to make them stiffly resiliently flexible whereby said second fingers impart an upward force against any downward flexing force thereon, one of said second fingers acting as a stop to a front edge of a shelf disposed on said shelf support member behind said one of said second fingers.

9. The unitary shelf bracket of claim 8 wherein:

said second fingers each have an attached end adjacent a front edge of said shelf support member and a free end adjacent said backplate.

10. In a unitary shelf bracket for mounting to vertically spaced holes in a vertical side member to support the end of a shelf with opposing top and bottom surfaces, said unitary shelf bracket having a backplate portion having front and back surfaces and a shelf support member extending horizontally outward normal to the front surface adjacent a bottom end thereof, the improvement to make the bracket self-adjusting and shelf-locking comprising:

a) forming the bracket of a tough resiliently flexible plastic;

b) a first peg lying on a centerline of the backplate portion, sized to fit into the holes, and extending outward normal to the back surface adjacent a top end thereof;

c) a second peg sized to fit into the holes extending outward normal to the back surface at a distance downward from said first peg such as to allow said first and second pegs to simultaneously fit into adjacent ones of the holes;

d) means for imparting a longitudinal centering force on said shelf incorporated into the backplate portion;

e) means for imparting a vertical compressive gripping force to said top and bottom surfaces of said shelf disposed on said shelf support member;

f) means for gripping a front edge of said shelf disposed on said shelf support member to prevent horizontal outward movement thereof; and, wherein said means for imparting a longtiudinal centering force on a shelf and said means for imparting a vertical gripping force on a shelf comprises:

a plurality of first fingers extending downward from adjacent said top end of said backplate at an acute angle thereto and terminating in respective bottom edges parallel to said shelf support member at different spaced distances therefrom, said first finger being of a thickness to make them stiffly resiliently flexible and comprising a tab-shaped finger disposed on a centerline and a plurality of U-shaped fingers wrapped around said tab-shaped finger.

11. The improvement to a unitary shelf bracket of claim 10 wherein:

said first fingers each have a retaining tab at said bottom edge thereof for gripping an edge of a shelf to maintain said bottom edge in an abutting relationship with said shelf.

12. The improvement to a unitary shelf bracket of claim 10 wherein:

said means for imparting a vertical gripping force and said means for gripping a front edge comprise a pair of upward tilted second fingers disposed at respective side edges of said shelf support member, said second fingers being of a thickness to make them stiffly resiliently flexible whereby said second fingers impart an upward force against any downward flexing force thereon, one of said second fingers acting as a stop to a front edge of a shelf disposed on said shelf support member behind said one of said second fingers.

13. The improvement to a unitary shelf bracket of claim 12 wherein:

said second fingers each have an attached end adjacent a front edge of said shelf support member and a free end adjacent said backplate.

14. A unitary shelf bracket of a tough resiliently flexible plastic for mounting to vertically spaced holes in a vertical side member to support the end of a shelf comprising:

a) a backplate portion having front and back surfaces;

b) a first peg lying on a centerline of said backplate portion, sized to fit into the holes, and extending outward normal to said back surface adjacent a top end thereof;

c) a second peg sized to fit into the holes extending outward normal to said back surface at a distance downward from said first peg such as to allow said first and second pegs to simultaneously fit into adjacent ones of the holes;

d) a shelf support member extending horizontally outward normal to said front surface adjacent a bottom end thereof;

e) centering means in said backplate portion for imparting a longitudinal centering force on a shelf disposed on said shelf support member, said centering means comprising a plurality of first fingers extending downward from adjacent said top end of said backplate at an acute angle thereto and terminating in respective bottom edges parallel to said shelf support member at different spaced distances therefrom, said first fingers being of a thickness to make them stiffly resiliently flexible; and, f) gripping and stop means for imparting a vertical gripping force on a shelf disposed on said shelf support member and for providing a stop to prevent horizontal outward movement of said shelf, said gripping and stop means comprising a pair of upward tilted second fingers disposed at respective side edges of said shelf support member, said second fingers being of a thickness to make them stiffly resiliently flexible whereby said second fingers impart an upward force against any downward flexing force thereon, one of said second fingers acting as a stop to a front edge of a shelf disposed on said shelf support member behind said one of said second fingers.

15. The unitary shelf bracket of claim 14 wherein:

said first fingers comprise a tab-shaped finger disposed on said centerline and a plurality of U-shaped fingers wrapped around said tab-shaped finger.

16. The unitary shelf bracket of claim 14 wherein:

said second fingers each have an attached end adjacent a front edge of said shelf support member and a free end adjacent said backplate.

17. The unitary shelf bracket of claim 14 wherein:

said first finger each have a retaining tab at said bottom edge thereof for gripping an edge of a shelf to maintain said bottom edge in an abutting relationship with said shelf.

* * * * *